US007945198B2

(12) United States Patent
Mitsuya et al.

(10) Patent No.: US 7,945,198 B2
(45) Date of Patent: May 17, 2011

(54) FIXING DEVICE AND IMAGE FORMING APPARATUS COMPRISING SAME

(75) Inventors: Teruaki Mitsuya, Tokyo (JP); Takashi Suzuki, Tokyo (JP); Keisuke Kubota, Tokyo (JP); Yoshihiro Sonohara, Tokyo (JP); Daisuke Hara, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 267 days.

(21) Appl. No.: 11/783,118

(22) Filed: Apr. 6, 2007

(65) Prior Publication Data

US 2007/0237554 A1 Oct. 11, 2007

(30) Foreign Application Priority Data

Apr. 6, 2006 (JP) ..... 2006-105267

(51) Int. Cl.
*G03G 15/20* (2006.01)

(52) U.S. Cl. ..... 399/329

(58) Field of Classification Search ..... 399/329
See application file for complete search history.

(56) References Cited

U.S. PATENT DOCUMENTS

| | | | | |
|---|---|---|---|---|
| 6,807,386 | B2 * | 10/2004 | Yasui et al. | 399/69 |
| 6,909,862 | B2 * | 6/2005 | Samei et al. | 399/69 |
| 2005/0036797 | A1 * | 2/2005 | Miura | 399/44 |
| 2005/0175919 | A1 * | 8/2005 | Hayashi et al. | 430/108.4 |
| 2005/0277048 | A1 * | 12/2005 | Tomita | 430/110.3 |
| 2006/0029411 | A1 * | 2/2006 | Ishii et al. | 399/67 |
| 2006/0165429 | A1 * | 7/2006 | Satoh et al. | 399/69 |
| 2006/0198646 | A1 * | 9/2006 | Funabiki et al. | 399/45 |
| 2007/0166085 | A1 * | 7/2007 | Shinshi | 399/329 |
| 2008/0107438 | A1 * | 5/2008 | Kinouchi et al. | 399/70 |
| 2008/0118264 | A1 * | 5/2008 | Mori et al. | 399/69 |
| 2008/0253788 | A1 * | 10/2008 | Shinshi | 399/69 |

FOREIGN PATENT DOCUMENTS

| | | |
|---|---|---|
| JP | 05-210327 | 8/1993 |
| JP | 2002-049257 | 2/2002 |
| JP | 2002-207393 | 7/2002 |
| JP | 2005-173358 | 6/2005 |

* cited by examiner

*Primary Examiner* — David M Gray
*Assistant Examiner* — Barnabas T Fekete
(74) *Attorney, Agent, or Firm* — Harness, Dickey & Pierce, P.L.C.

(57) ABSTRACT

In a fixing device in which fixing defects can be suppressed and which can be reduced in size, and an image forming apparatus comprising the fixing device, setting is performed such that the surface temperature of an outer peripheral belt surface serving as a non-heated belt surface of a fixing belt is substantially equal at a heating region inlet at the upstream end of a heating region and a heating region outlet at the downstream end of the heating region such that the temperature difference between the surface temperature of the outer peripheral belt surface at the heating region inlet and the surface temperature of the outer peripheral belt surface at the heating region outlet is no more than 5 [° C.].

20 Claims, 5 Drawing Sheets

E
TH
TM
TL
A
B
W
ℓA
ℓB
POSITION
TE
TA
TB
TEMPERATURE
TH
TM
TL

FIXING DEVICE AND IMAGE FORMING APPARATUS COMPRISING SAME

PRIORITY STATEMENT

This non-provisional application claims priority under 35 U.S.C. §119 to Japanese Patent Application No. 2006-105267, filed on Apr. 6, 2006, in the Japanese Patent Office, the entire contents of which are incorporated herein by reference.

BACKGROUND OF THE INVENTION

1. Field of the Invention

The present invention relates to a fixing device comprising a fixing member that is heated by heating means and pressing means for pressing the fixing member, which fixes an unfixed toner image onto a recording body using heat from the heated fixing member and pressure generated when the pressing means and fixing member are pressed together, and an image forming apparatus comprising the fixing device.

2. Description of the Background Art

An image forming apparatus employing an electrophotographic method comprises an image creation process for creating a toner image on the surface of a recording body using toner serving as coloring particles, and a fixing process for fixing the created toner image on the recording body. The toner melts when heated and coagulates when cooled. In the fixing process, the physical properties of the toner are taken into account when heating the toner until the toner melts, whereupon the toner is fixed onto the recording body surface.

A conventional fixing device for fixing a toner image on a recording body surface comprises a heat roller having heating means such as a halogen heater disposed in its interior, and a pressure roller that is pressed against the heat roller by a coil spring or the like to form a nip portion between itself and the heat roller. In this type of fixing device, a recording body carrying a toner image is passed over the surface of the nip portion between the heat roller and pressure roller such that heat and pressure are applied to the toner image, and as a result, the toner image is fixed onto the recording body.

In this type of fixing device, an elastic layer is required on the heat roller surface which contacts the toner on the recording body surface to improve the fixing quality. In this case, however, the elastic layer forms a thermal resistance layer when thermal conduction occurs in an outward direction from the heating means in the interior of the heat roller, and hence there is a limit to the thickness of the elastic layer on the heat roller. As a result, it is difficult to make the elastic layer sufficiently effective.

A fixing device described in Japanese Unexamined Patent Application Publication 2002-49257 is a fixing device capable of solving this problem. The fixing device described in Japanese Unexamined Patent Application Publication 2002-49257 has a fixing belt that performs an endless motion while stretched by a plurality of stretching members and is heated by heating means. A pressure roller serving as pressing means for pressing the fixing belt is also provided, and the plurality of stretching members comprises a heating roller serving as the heating means and a fixing roller that opposes the pressure roller via the fixing belt to form a nip portion. In this fixing device, the fixing belt heated by the heating roller moves endlessly toward the nip portion, and by passing a recording body carrying toner through the nip portion, a toner image on the recording body is fixed by the heat of the fixing belt and the pressure of the nip portion. Since both the heating roller and fixing roller are provided such that the heating function and the pressing function are separated, the fixing roller opposing the toner on the recording body surface via the fixing belt may be provided with a thick elastic layer, and therefore, a high quality color image can be obtained.

In the fixing device described above, comprising the heating roller and the fixing roller, the location in which the fixing belt is wrapped around the heating roller serves as a heating region in which the inner peripheral surface of the fixing belt contacts the heating roller such that heat is transferred from the heating roller to the fixing belt. In this type of fixing device, the heating region for heating the fixing belt is typically made long enough to ensure that the outer peripheral surface of the fixing belt at the downstream end of the heating region in the endless motion direction of the fixing belt can be heated to a suitable temperature for fixing. By making the heating region long enough and heating the fixing belt to an extent at which the outer peripheral surface of the fixing belt reaches a suitable temperature for fixing, the toner on the recording body can be heated sufficiently in the nip portion, and fixing can be performed favorably.

However, when the fixing belt is heated to an extent at which the outer peripheral surface of the fixing belt reaches a suitable temperature for fixing, heating is performed with poor heating efficiency. The reason for this is as follows.

During initial heating of the fixing belt, heat that is transferred from the heating means to the surface (to be referred to hereafter as the heated belt surface) of the fixing belt opposing the heating means propagates through the interior of the fixing belt and reaches the rear surface (to be referred to hereafter as the non-heated belt surface) of the heated belt surface in such a manner that the amount of heat transferred from the heating means to the fixing belt per unit time is substantially constant. When the heat transferred from the heating means propagates to the non-heated belt surface, the temperature of the non-heated belt surface begins to rise such that the temperature difference between the surface temperature of the heated belt surface, which is substantially identical to the temperature of the heating means, and the surface temperature of the non-heated belt surface begins to decrease. When the temperature difference between the heated belt surface and non-heated belt surface decreases, heat is transferred from the heated belt surface to the non-heated belt surface less easily, and the amount of heat transferred from the heating means to the heated belt surface per unit time decreases. As the temperature of the non-heated belt surface increases, the amount of heat transferred from the heating means to the heated belt surface per unit time decreases gradually, leading to a gradual reduction in the heating efficiency of the heating that is performed after the heat transferred from the heating means propagates to the non-heated belt surface.

When the fixing belt is heated continuously until the outer peripheral surface of the fixing belt reaches a suitable temperature for fixing, as in this conventional fixing device, the amount of heat transferred from the heating roller to the fixing belt per unit time decreases as the outside surface of the fixing belt approaches a suitable temperature for fixing, and as a result, the heating efficiency deteriorates.

When heating is performed with poor heating efficiency, the time required for heating increases. When the process speed is determined in accordance with the image creation speed of the image creation process, the fixing belt performs an endless motion at a linear speed corresponding to the image creation speed, and therefore the heating region must be increased in length to secure the required heating time. To secure the required length of the heating region, the diameter of the heating roller must be increased, and as a result, the fixing device must be increased in size.

Technologies relating to the present invention are also disclosed in, e.g. Japanese Patent No. 2,909,499.

SUMMARY OF THE INVENTION

The present invention has been designed in consideration of the problems described above, and it is an object thereof to provide a fixing device in which fixing defects can be suppressed and which can be reduced in size, and an image forming apparatus comprising the fixing device.

In an aspect of the present invention, a fixing device comprises a fixing belt that performs an endless motion while stretched by a plurality of stretching members and is heated by heating means; and pressing means for pressing the fixing belt. The fixing belt heated in a heating region in which the heating means heat the fixing belt performs an endless motion to a pressing portion in which the pressing means press the fixing belt, and a recording body carrying an unfixed toner image passes through the pressing portion such that the unfixed toner image is fixed onto the recording body by heat from the fixing belt and pressure from the pressing means. On a non-heated belt surface, which is a surface of the fixing belt on a rear side of a heated belt surface facing the heating means, a temperature difference between a surface temperature of the non-heated belt surface at an upstream end of the heating region in a fixing belt endless motion direction and the surface temperature of the non-heated belt surface at a downstream end of the heating region in the fixing belt endless motion direction is no more than 5 [° C.]. The surface temperature of the non-heated belt surface at an upstream end of the pressing portion in the fixing belt endless motion direction is higher than the surface temperature of the non-heated belt surface at the upstream end of the heating region in the fixing belt end less motion direction.

In another aspect of the present invention, a fixing device comprises a fixing belt that performs an endless motion while stretched by a plurality of stretching members and is heated by heating means; and pressing means for pressing the fixing belt. The fixing belt heated in a heating region in which the heating means heat the fixing belt performs an endless motion to a pressing portion in which the pressing means press the fixing belt, and a recording body carrying an unfixed toner image passes through the pressing portion such that the unfixed toner image is fixed onto the recording body by heat from the fixing belt and pressure from the pressing means. When a time required for the fixing belt to pass a downstream end of the heating region in a fixing belt endless motion direction after passing an upstream end of the heating region in the fixing belt endless motion direction is $T_1$ [s]. A time required for the fixing belt to pass an upstream end of the pressing portion in the fixing belt endless motion direction after passing the upstream end of the heating region in the fixing belt endless motion direction is $T_2$ [s]. A thickness of the fixing belt is D [m], and a thermal diffusivity of the fixing belt is a [$m^2$/s]. A following Eq. (5) is satisfied:

$$\sqrt{a \cdot T_1} \leqq D \leqq \sqrt{a \cdot T_2} \quad \text{Eq. (5)}$$

where, when a thermal conductivity is λ [J/s×m×K], a density is ρ [kg/$m^3$], and a specific heat is Cp [J/kg×K], the thermal diffusivity a [$m^2$/s] takes a value determined by a following Eq. (2):

$$a = \lambda / (\rho \cdot Cp) \quad \text{Eq. (2)}$$

In another aspect of the present invention, an image forming apparatus comprises image carrying means; image forming means for forming a latent image on the image carrying means; developing means for developing the latent image on the image carrying means to form a toner image; transfer means for transferring the toner image to a recording body; and fixing means for fixing the toner image onto the recording body. The fixing means comprises a fixing belt that performs an endless motion while stretched by a plurality of stretching members and is heated by heating means; and pressing means for pressing the fixing belt. The fixing belt heated in a heating region in which the heating means heat the fixing belt performs an endless motion to a pressing portion in which the pressing means press the fixing belt, and the recording body carrying an unfixed toner image passes through the pressing portion such that the unfixed toner image is fixed onto the recording body by heat from the fixing belt and pressure from the pressing means. On a non-heated belt surface, which is a surface of the fixing belt on a rear side of a heated belt surface facing the heating means, a temperature difference between a surface temperature of the non-heated belt surface at an upstream end of the heating region in a fixing belt endless motion direction and the surface temperature of said non-heated belt surface at a downstream end of the heating region in the fixing belt endless motion direction is no more than 5 [° C.]. The surface temperature of the non-heated belt surface at an upstream end of the pressing portion in the fixing belt endless motion direction is higher than the surface temperature of the non-heated belt surface at the upstream end of the heating region in the fixing belt endless motion direction.

In another aspect of the present invention, an image forming apparatus comprises image carrying means; image forming means for forming a latent image on the image carrying means; developing means for developing the latent image on the image carrying means; transfer means for transferring the toner image to a recording body; and fixing means for fixing the toner image on the recording body. The fixing means comprises a fixing belt that performs an endless motion while stretched by a plurality of stretching members and is heated by heating means; and pressing means for pressing the fixing belt. The fixing belt heated in a heating region in which the heating means heat the fixing belt performs an endless motion to a pressing portion in which the pressing means press the fixing belt, and the recording body carrying an unfixed toner image passes through the pressing portion such that the unfixed toner image is fixed onto the recording body by heat from the fixing belt and pressure from the pressing means. When a time required for the fixing belt to pass a downstream end of the heating region in a fixing belt endless motion direction after passing an upstream end of the heating region in the fixing belt endless motion direction is $T_1$ [s]. A time required for the fixing belt to pass an upstream end of the pressing portion in the fixing belt endless motion direction after passing the upstream end of the heating region in the fixing belt endless motion direction is $T_2$ [s]. A thickness of the fixing belt is D [m], and a thermal diffusivity of the fixing belt is a [$m^2$/s]. A following Eq. (5) is satisfied:

$$\sqrt{a \cdot T_1} \leqq D \leqq \sqrt{\sqrt{a \cdot T_2}} \quad \text{Eq. (5)}$$

where, when a thermal conductivity is λ [J/s×m×K], a density is ρ [kg/$m^3$], and a specific heat is Cp [J/kg×K], the thermal diffusivity a [$m^2$/s] takes a value determined by a following Eq. (2):

$$a = \lambda / (\rho \cdot Cp) \quad \text{Eq. (2)}$$

BRIEF DESCRIPTION OF THE DRAWINGS

The above and other objects, features, and advantages of the present invention will become more apparent from the following detailed description taken with the accompanying drawings, in which.

DESCRIPTION OF THE PREFERRED EMBODIMENT

An embodiment in which the present invention is applied to a printer 100 serving as an image forming apparatus will be described in detail below.

First, the schematic constitution of the printer 100 will be described using FIG. 1.

The printer 100 functions as a so-called digital color copier for scanning and reading an original, digitizing the read original, and copying the original onto a recording body. The printer 100 also functions as a facsimile for transmitting and receiving original image information to and from a remote location, and as a so-called printer for printing image information held by a computer onto a sheet of paper.

Figure 1:
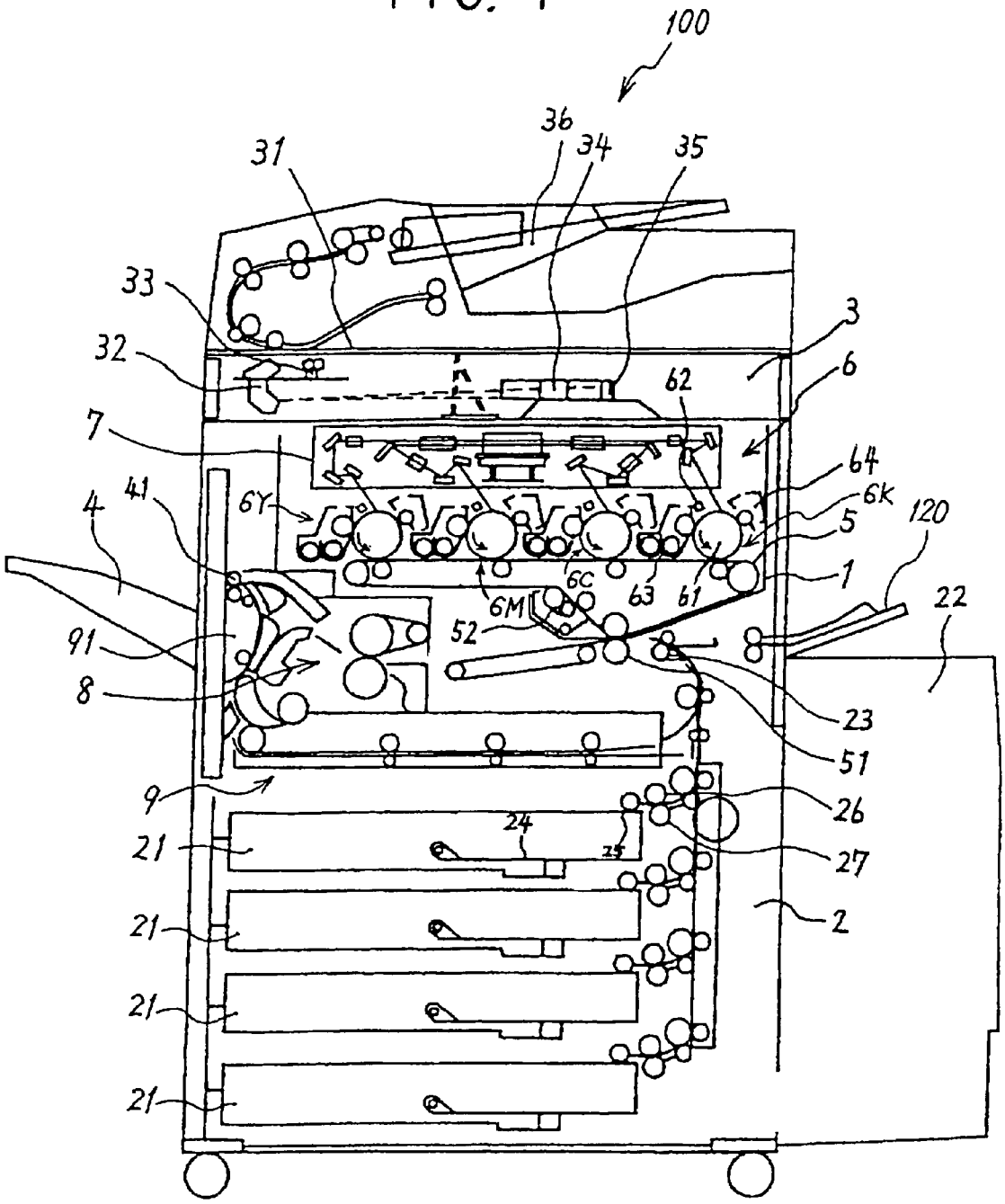
FIG. 1 is a view showing the schematic constitution of a printer according to an embodiment of the present invention.

In FIG. 1, an image forming unit 1 is provided substantially in the center of the printer 100. A multi-stage sheet feeding unit 2 is disposed beneath the image forming unit 1. Sheet feeding trays 21 serving as sheet feeding devices carrying stacks of sheets such as plain paper, OHP sheets, and tracing paper serving as a recording body are provided in each stage of the sheet feeding unit 2. The sheet feeding unit 2 is constituted so that another sheet feeding device 22 may be added as required. An openable manual sheet feeding tray 120 is provided on the right side of the image forming unit 1 in the drawing. As shown in the drawing, when the upper portion is opened in a direction moving away from the main body, a stack of sheets may be placed on the manual sheet feeding tray 120. A reading unit 3 for reading an original is disposed above the image forming unit 1. Further, a sheet discharge and storage unit 4 for discharging and storing image-formed sheets is disposed on the left side of the image forming unit 1.

In the image forming unit 1, image creation units 6 in each of four colors for forming four individual toner images are disposed in series so as to face the outer peripheral surface of an endless intermediate transfer belt 5. Each image creation unit 6 comprises a drum-shaped photosensitive body 61. A charging device 62 for performing charging processing on the surface of the photosensitive body 61 and an exposure device 7 for irradiating the surface of the photosensitive body 61 with image information using laser light are disposed on the periphery of each photosensitive body 61. A development device 63 for visualizing an electrostatic latent image formed through exposure on the surface of the photosensitive body 61 and a cleaning device 64 for removing and collecting toner remaining on the photosensitive body 61 are also provided.

Reading traveling bodies 32, 33 constituted by an original illumination light source and a mirror are disposed in the reading unit 3 so as to be free to perform a reciprocating motion in order to read and scan an original (not shown) placed on a contact glass 31. Image information scanned by the reading traveling bodies 32, 33 is read as an image signal by a CCD 35 disposed to the rear of a lens 34. The read image signal is digitized and subjected to image processing. On the basis of the image-processed signal, an electrostatic latent image is formed on the surface of the photosensitive body 61 using light generated by a laser diode LD (not shown) in the exposure device 7. An optical signal from the LD reaches the photosensitive body 61 via a well-known polygon mirror or lens. An automatic original conveyance device 36 for conveying the original onto the contact glass 31 automatically is mounted above the reading unit 3.

A transfer device 51 for transferring a full color toner image formed on the intermediate transfer belt 5 to the recording body is disposed on the periphery of the intermediate transfer belt 5. An intermediate transfer cleaning device 52 for removing and collecting toner remaining on the surface of the intermediate transfer belt 5 after the full color toner image has been transferred onto the recording body by the transfer device 51 is also provided.

Next, an image creation process of the image forming apparatus will be described.

In each image creation unit 6 in FIG. 1, four color toner images are formed on each photosensitive body 61 by a well-known electrophotographic process at a predetermined timing corresponding to the rotation of the intermediate transfer belt 5. First, a yellow toner image formed on the left end photosensitive body is transferred onto the intermediate transfer belt 5 by a yellow image creation unit 6Y.

A magenta toner image formed on the next photosensitive body is then transferred onto the intermediate transfer belt 5 by a magenta image creation unit 6M so as to be superposed onto the yellow toner image. A cyan toner image formed on the next photosensitive body is then transferred onto the intermediate transfer belt 5 by a cyan image creation unit 6C so as to be superposed onto the magenta toner image. A black toner image formed on the right end photosensitive body is then transferred onto the intermediate transfer belt 5 by a black image creation unit 6K so as to be superposed onto the cyan toner image. By sequentially superposing and transferring the four color toner images formed on the respective photosensitive bodies in this manner, a full color toner image is formed on the intermediate transfer belt 5.

In parallel with the image forming operation to form the full color toner image on the intermediate transfer belt 5, recording bodies are separated from the selected sheet feeding tray 21 of the sheet feeding unit 2 and fed one sheet at a time. More specifically, in the sheet feeding unit 2 shown in the drawing, a stack of recording bodies is carried on a base plate 24 supported rotatably on the sheet feeding tray 21. By rotating the base plate 24, the top recording body of the recording body stack is lifted to a position enabling contact with a pickup roller 25. The top recording body is fed by the rotation of the pickup roller 25 and separated by a reverse roller 27. The separated top recording body is then moved away from the sheet feeding tray 21 by the rotation of a sheet feeding roller 26, and conveyed to a resist roller 23 disposed on the downstream side of a conveyance path.

The separated and conveyed recording body is stopped temporarily when it abuts against a nip of the resist roller 23 and enters a standby state. The resist roller 23 is controlled to begin rotating when the positional relationship between the full color toner image formed on the intermediate transfer belt 5 and the tip end of the recording body reaches a predetermined position. The recording body on standby is fed again when the resist roller 23 rotates. Thus, the full color toner image formed on the intermediate transfer belt 5 is transferred onto a predetermined position of the recording body by the transfer device 51.

The recording body transferred with the full color toner image in this manner is then conveyed to a fixing device 8 on the downstream side of the conveyance path. The fixing device 8 fixes the full color toner image transferred by the transfer device 51 onto a sheet. The fixing device 8 will be described in detail below. The recording body fixed with the full color toner image is discharged and stored in the sheet discharge and storage unit 4 by a discharge roller 41.

When images are to be formed on both sides of the recording body, the recording body is diverted by a diversion unit 91 and passed through a duplex device 9 such that the front and back of the recording body are reversed. The reversed recording body is then caused to abut against the nip of the resist roller 23 to correct skew, whereupon image formation is performed on the rear surface in a similar manner to the simplex image formation described above.

Next, the fixing device 8 according to this embodiment will be described with reference to FIG. 2.

Figure 2:
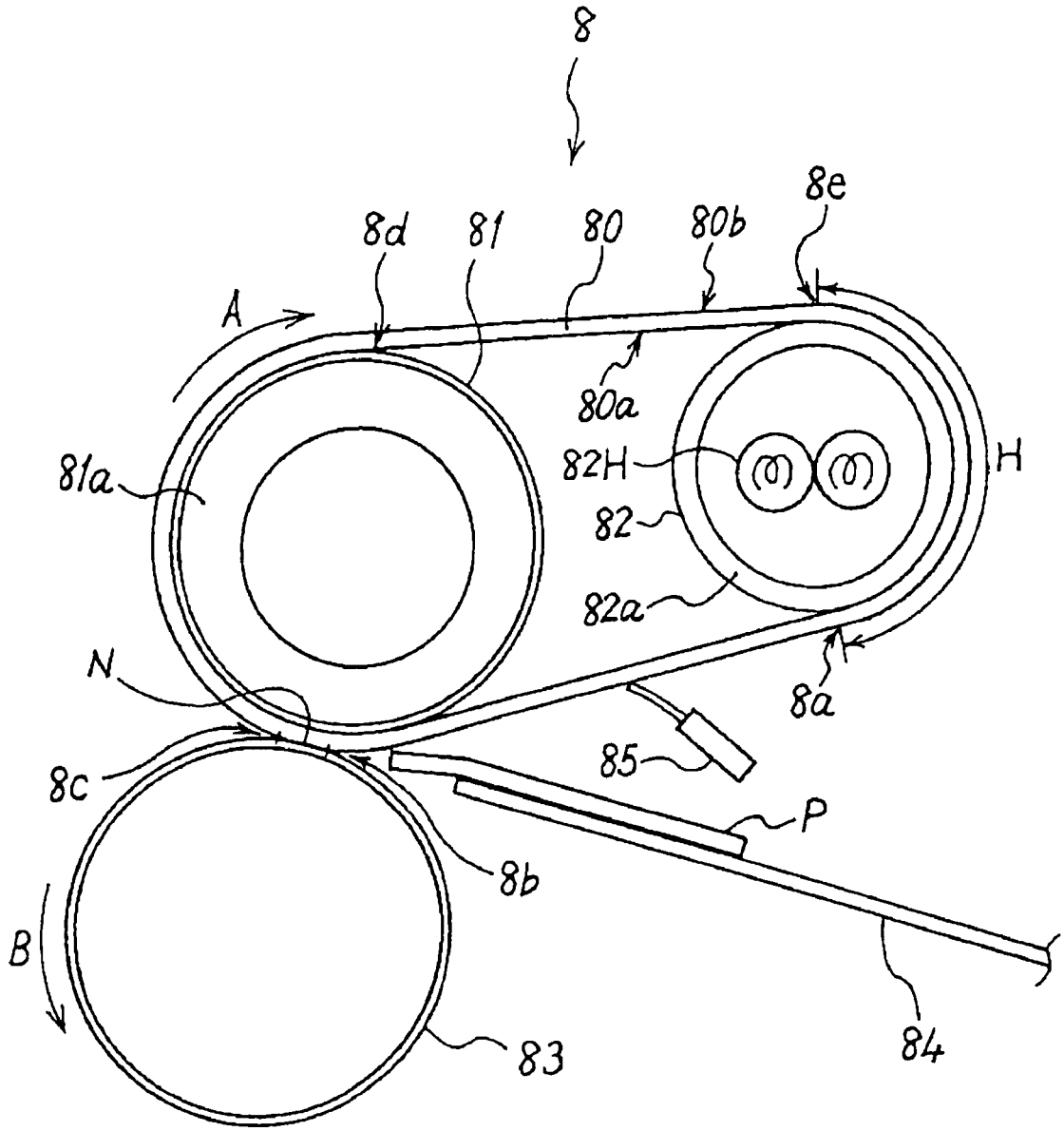
FIG. 2 is a view showing the schematic constitution of a fixing device pertaining to the printer.

As shown in FIG. 2, the fixing device 8 comprises a fixing belt 80 looped around a fixing roller 81 serving as a stretching member facing pressing means and a heating roller 82 serving as a stretching member and as heating means, which performs an endless motion in the direction of an arrow A in the drawing. A pressure roller 83 is provided as the pressing means in a position facing the fixing roller 81 so as to form a fixing nip N serving as a pressing portion in which the pressure roller 83 presses against the fixing roller 81 via the fixing belt 80, and the pressure roller 83 presses the fixing roller 81 with an appropriate pressing force.

The fixing roller 81 is driven to rotate by a drive source not shown in the drawing, and the fixing belt 80 performs an endless motion in the direction of the arrow A in the drawing. As a result, the heating roller 82 is driven to rotate. Further, the rotation produced by the drive source is transmitted to the pressure roller 83 via a gear, not shown in the drawing, and thus the pressure roller 83 is driven to rotate in the direction of an arrow B in the drawing.

In the fixing device 8, an inner peripheral belt surface 80*a* of the fixing belt 80, which contacts the fixing roller 81 and heating roller 82, forms a heated belt surface to which heat from the heating roller 82 is transferred. Further, an outer peripheral belt surface 80*b* (which is on the rear side of the fixing belt 80 relative to the inner peripheral belt surface 80*a*) forms a non-heated belt surface to which the heat of the inner peripheral belt surface 80*a* propagates so as to heat the toner image on a transfer sheet P serving as the recording body at the fixing nip N. The region in which the inner peripheral belt surface 80*a* is wrapped around the heating roller 82 serves as a heating region H in which heat is transferred from the heating roller 82 to the fixing belt 80.

The fixing belt 80 heated by the heating roller 82 in the heating region H performs an endless motion to reach the fixing nip N, and when the transfer sheet P serving as the recording body carrying the toner image passes through the fixing nip N, the toner image is fixed onto the transfer sheet P by the heat of the fixing belt 80 and the pressure between the pressure roller 83 and fixing roller 81.

The center of the rotary shaft of the heating roller 82 is hollow, and a heater 82H serving as heating means is installed in the interior thereof. The heating roller 82 is heated by the heater 82H. Thus, the fixing belt 80, which is stretched around the fixing roller 81 and heating roller 82, is heated. Further, a thermistor 85 serving as fixing temperature detecting means for detecting the surface temperature of the fixing belt 80 is provided to manage the fixing temperature, and on the basis of the detection result of the thermistor 85, the operation of the heater 82H is controlled such that the temperature of the fixing belt 80 is set at a suitable temperature for fixing.

A belt having a multilayer structure and high thermal resistance, comprising a base layer constituted by polyimide resin or the like, for example, an elastic layer provided on the base layer and constituted by fluorine rubber, silicone rubber, or the like, and a surface layer provided on the elastic layer and serving as a mold release layer constituted by a fluorine resin such as PFA (tetra fluoro ethylene-perfluoro alkylvinyl ether copolymer) or PFA and PTFE (poly tetra fluoro ethylene), may be used as the fixing belt 80.

The fixing roller 81 and pressure roller 83 are constituted by a metal core portion, an elastic layer provided on the surface of the core portion and constituted by silicone rubber, and a surface layer laminated onto the surface of the elastic layer and constituted by PFA or fluorine resin.

The heating roller 82 is constituted by a heating roller core portion 82*a* made of a metal such as aluminum, and a surface layer (not shown) serving as a mold release layer constituted by fluorine resin. The material of the heating roller core portion 82*a* preferably has large thermal conductivity, and a metal such as iron, copper, and stainless steel may also be used. The surface layer is constituted by fluorine resin to improve the wear resistance of the surface of the heating roller 82. Further, when the heating roller core portion 82*a* is constituted by aluminum, an aluminum oxide layer is preferably formed by subjecting the outer surface thereof to alumite processing.

Hence, when the pressure roller 83 and fixing roller 81, each comprising an elastic layer, press against each other via the fixing belt 80, the fixing nip N serving as a contact portion between the fixing belt 80 and pressure roller 83 can be formed comparatively widely.

Since the pressing function and heating function are separated by means of the fixing roller 81 and heating roller 82 such that there is no need to heat the fixing roller 81 from the inside, the fixing roller 81 can be provided with a thick elastic layer 81*a* as shown in FIG. 2, and therefore the fixing nip N can be formed widely and the fixing belt 80 can be brought into tighter contact with the toner image on the transfer paper P. As a result, fixing can be realized favorably.

The fixing device 8 is further provided with a guide member 84 and so on for guiding the transfer paper P serving as the recording body to be fixed toward the fixing nip N. Furthermore, although not shown in the drawing, an oil applying member for applying an offset preventing oil, a cleaning member to be used when toner adheres to the belt, and so on may be provided above the fixing belt 80.

Note that in the fixing device 8, the fixing belt 80 is stretched across two rollers, i.e. the fixing roller 81 and the heating roller 82, but another roller or support member may be used such that the fixing belt 80 is stretched across three or more support members.

Further, the heating roller 82 is biased in a direction heading away from the fixing roller 81 by an elastic body such as a spring, not shown in the drawing, in order to apply an appropriate predetermined tension to the fixing belt 80.

8*a* to 8*e* in FIG. 2 denote positions of the fixing belt 80 within the fixing device 8. 8*a* is a heating region outlet at the downstream end of the heating region H, in which the inner peripheral belt surface 80*a* contacts the heating roller 82, in the endless motion direction of the fixing belt 80. 8*b* is a fixing nip inlet at the upstream end of the fixing nip N, which serves as the pressing portion, in the endless motion direction of the fixing belt 80. 8*c* is a fixing nip outlet at the downstream end of the fixing nip N, which serves as the pressing portion, in the endless motion direction of the fixing belt 80. 8*d* is a fixing roller separation portion in which the inner peripheral belt surface 80*a* separates from the fixing roller 81. 8*e* is a heating region inlet at the upstream end of the heating region H, in which the inner peripheral belt surface 80*a* contacts the heating roller 82, in the endless motion direction of the fixing belt 80.

FIGS. 3A to 3E show the temperature distribution in the thickness direction of the fixing belt 80 in the positions of the fixing device 8 denoted by 8*a* to 8*e* in FIG. 2. FIGS. 3A to 3E correspond respectively to the temperature distribution of the fixing belt 80 in each of the positions 8*a* to 8*e* in FIG. 2. Note that in FIGS. 3A to 3E, the rear surface is the inner peripheral belt surface 80*a* and the front surface is the outer peripheral belt surface 80*b*.

Figure 3A:
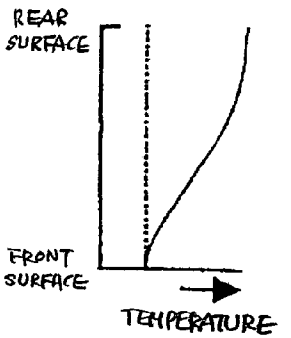
FIG. 3A is a view showing temperature distribution at a heating region outlet in a thickness direction of a fixing belt in a plurality of positions of the fixing device.

In the temperature distribution diagrams shown in FIGS. 3A to 3E, the ordinate shows the thickness direction position of the fixing belt 80, and the abscissa shows the temperature in each position. The solid lines in the drawings show the temperature distribution in each position, and the broken lines show the temperature distribution in the position on the upstream side of the temperature distribution position shown by the solid line in the endless motion direction of the fixing belt 80. In FIG. 3A, for example, the solid line shows the temperature distribution of the fixing belt 80 at the heating region outlet 8*a*, and the broken line shows the temperature distribution at the heating region inlet 8*e*.

Figure 3B:
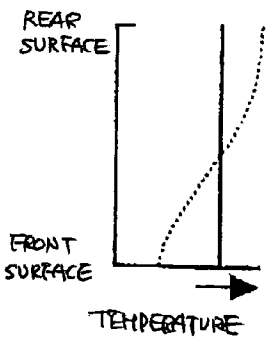
FIG. 3B is a view showing temperature distribution at a fixing nip inlet.
Figure 3C:
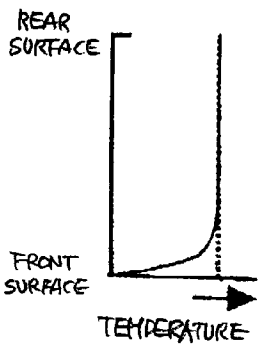
FIG. 3C is a view showing temperature distribution at a fixing nip outlet.
Figure 3D:
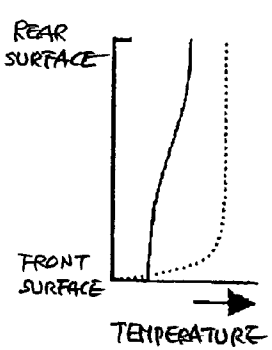
FIG. 3D is a view showing temperature distribution at a fixing roller separation portion.
Figure 3E:
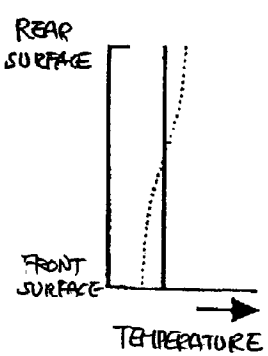
FIG. 3E is a view showing temperature distribution at a heating region inlet.

In a fixing device comprising the fixing belt 80, such as the fixing device 8, after the fixing belt 80 passes through the fixing nip N and the fixing roller separation portion 8*d* to reach the heating region inlet 8*e*, the temperature distribution in the interior of the fixing belt 80 from the inner peripheral belt surface 80*a* to the outer peripheral belt surface 80*b* is substantially flat, as shown by the solid line in FIG. 3E.

While the fixing belt 80 is wrapped around the heating roller 82, the inner peripheral belt surface 80*a* is heated, and when the heat propagates to the outer peripheral belt surface 80*b*, the surface temperature of the outer peripheral belt surface 80*b* begins to rise.

In the fixing device 8, the surface temperature of the heating roller 82 is substantially constant. Until the temperature of the outer peripheral belt surface 80*b* begins to rise, the temperature difference between the outer peripheral belt surface 80*b* and the inner peripheral belt surface 80*a*, the temperature of which is substantially identical to the temperature of the heating roller 82, is substantially constant, and the amount of heat transferred from the heating roller 82 to the fixing belt 80 per unit time is also substantially constant.

When the heat from the heating roller 82 propagates to the outer peripheral belt surface 80*b*, the temperature of the outer peripheral belt surface 8*b* begins to rise, the temperature difference between the outer peripheral belt surface 80*b* and the inner peripheral belt surface 80*a* decreases, heat is transmitted from the outer peripheral belt surface 80*b* to the inner peripheral belt surface 80*a* less easily, and the amount of heat transferred from the heating roller 82 to the fixing belt 80 per unit time decreases. Since the amount of heat transferred per unit time decreases, the heating efficiency deteriorates.

In a conventional fixing device, in which heating is performed until the non-heated belt surface reaches a suitable temperature for fixing, the heating efficiency of heating performed after the heat transferred from the heating roller to the heated belt surface has propagated to the non-heated belt surface is poor.

Next, the constitutional features of the fixing device 8 according to this embodiment will be described.

In the fixing device 8, the surface temperature of the outer peripheral belt surface 80*b* is made substantially equal at the heating region outlet 8*a* and the heating region inlet 8*e* such that temperature difference in the surface temperature of the outer peripheral belt surface 80*b* between these two positions is no more than 5 [° C.].

While the fixing belt 80 performs an endless motion from the heating region inlet 8*e* to the heating region outlet 8*a*, heat is believed to travel into the air from the outer peripheral belt surface 80*b*, but the amount of heat transferred into the air per unit time is negligible when compared to the amount of heat transferred through the entire fixing apparatus 8. While the fixing belt 80 performs an endless motion from the heating region inlet 8*e* to the heating region outlet 8*a*, the inner peripheral belt surface 80*a* contacts the heating roller 82 and is heated thereby. In this state, the surface temperature of the outer peripheral belt surface 80*b* is substantially equal at the heating region outlet 8*a* and the heating region inlet 8*e*, and therefore, while the fixing belt 80 is heated in the heating region H, the heat that is transferred from the heating roller 82 to the fixing belt 80 does not propagate to the outer peripheral belt surface 80*b*. Hence, during heating in the heating region H, the amount of heat transferred from the heating roller 82 to the fixing belt 80 per unit time does not decrease, and heating can be performed efficiently.

Next, the temperature distribution in each position of the fixing device 8 according to this embodiment will be described.

As regards the temperature distribution of the fixing belt 80 at the heating region outlet 8*a*, shown by the solid line in FIG. 3A, the temperature of the inner peripheral belt surface 80*a* is substantially equal to the surface temperature of the heating roller 82. On the other hand, at exactly this time, thermal conduction affects the outer peripheral belt surface 80*b*, and hence the surface temperature thereof is substantially equal to the surface temperature of the outer peripheral belt surface 80*b* according to the temperature distribution at the heating region inlet 8*e*, shown by the broken line.

Thermal conduction progresses further as the fixing belt 80 performs an endless motion from the heating region outlet 8*a* to the fixing nip inlet 8*b*, and the temperature distribution of the fixing belt 80 enters a state in which the temperature thereof is substantially equal from the rear surface to the front surface, as shown by the solid line in FIG. 3B.

At this time, the temperature of the fixing belt 80 reaches a fixing temperature, i.e. a suitable temperature for fixing the toner. In other words, the temperature of the heating roller 82 is set such that at the fixing nip inlet 8*b*, the temperature of the fixing belt 80 reaches a fixing temperature required for fixing.

Hence, in the fixing device 8, each member is set such that the temperature of the fixing belt 80 reaches the required fixing temperature at the fixing nip inlet 8*b* and such that a temperature distribution according to which the temperature of the inner peripheral surface and the temperature of the outer peripheral surface of the fixing belt 80 are substantially equal is achieved. In so doing, toner fixing can be performed with optimum efficiency.

In the fixing nip N, great thermal transport occurs on the surface layer of the outer peripheral surface of the fixing belt 80. The reason for this is that the temperature of the transfer sheet P carrying the toner is low, and therefore the scale of the thermal transport (the heat flux) increases. Although heat flux is great, the time required for the fixing belt 80 to pass through the fixing nip N (the nip time) is shorter than other heat transfer times, and therefore the range affected by thermal conduction is limited to the surface layer portion of the fixing belt 80.

This can also be deduced from the fact that in the temperature distribution at the fixing nip outlet 8*c*, shown in FIG. 3C, only the front surface cools.

After passing through the fixing nip N, thermal conduction to the interior of the fixing belt 80 progresses, and in the fixing roller separation portion 8*d* where the fixing belt 80 separates from the fixing roller 81, the temperature distribution of the fixing belt 80 is largely, albeit insufficiently, even, as shown in FIG. 3D.

Thermal conduction for evening out the temperature distribution of the fixing belt 80 continues until the fixing belt 80 reaches the heating region inlet 8*e*, and at the heating region inlet 8*e*, the temperature distribution of the fixing belt 80 becomes even, as shown in FIG. 3E. Upon reaching the heating region inlet 8*e*, the fixing belt 80 arrives at the wrapped portion wrapped around the heating roller 82, or in other words the heating region H. While the fixing belt 80 is wrapped around the heating roller 82, the inner peripheral surface side of the fixing belt 80 is heated.

When heat transferred to the fixing belt 80 by the heating performed in the heating region H propagates to the outer peripheral belt surface 80*b*, the surface temperature of the outer peripheral belt surface 80*b* begins to rise. However, even though the surface temperature of the outer peripheral belt surface 80*b* rises, the temperature of the heating roller 82 remains substantially constant, and therefore the temperature difference between the inner peripheral belt surface 80*a*, the temperature of which is substantially identical to the temperature of the heating roller 82, and the outer peripheral belt surface 80*b* decreases. As a result, it becomes more difficult for heat to propagate through the interior of the fixing belt 80 from the inner peripheral belt surface 80*a* to the outer peripheral belt surface 80*b*, leading to a reduction in the amount of heat transferred from the heating roller 82 to the fixing belt 80 per unit time and a reduction in the heating efficiency.

When heating is performed with reduced heating efficiency, heat is not transferred easily even when an attempt is made to transfer a large amount of heat to the fixing belt 80 by increasing the diameter of the heating roller 82. Note that when the surface temperature of the outer peripheral belt surface 80*b* of the fixing belt 80 and the surface temperature of the heating roller 82 match, heat is no longer transferred from the heating roller 82 to the fixing belt 80.

In the fixing device 8 of this embodiment, the surface temperature of the outer peripheral belt surface 80*b* of the fixing belt 80 at the heating region inlet 8*e* and the surface temperature of the outer peripheral belt surface 80*b* at the heating region outlet 8*a* are set to substantially match so that a reduction in the efficiency of the heating performed by the heating roller 82 does not occur. Hence, before the heat that is transferred to the fixing belt 80 due to the heating performed in the heating region H propagates to the outer peripheral belt surface 80*b*, the fixing belt 80 passes through the heating region H and separates from the heating roller 82, and the efficiency of the heating performed by the heating roller 82 in the heating region H can be maintained at a high level. Further, the surface temperature of the outer peripheral belt surface 80*b* at the fixing nip inlet 8*b* is set to be higher than the surface temperature of the outer peripheral belt surface 80*b* at the heating region inlet 8*e*. Hence, the heat transferred to the fixing belt 80 due to the heating performed in the heating region H can be made to contribute to fixing from the inlet of the fixing nip N.

The thickness of the fixing belt 80 is set to be thicker than a thickness at which the heat transferred to the fixing belt 80 from the heating roller 82 propagates through the interior of the fixing belt 80 while the fixing belt 80 passes through the heating region H. In so doing, the efficiency of the heating performed in the heating region H can be maintained at a high level.

If the thermal diffusivity of the fixing belt 80 is a [$m^2/s$] and the elapsed time from the point at which the fixing belt 80 passes the heating region inlet 8*e*, i.e. the upstream end of the heating region H in the endless motion direction, is $T_1$ [s], a temperature penetration thickness $d_1$ [m], which is a thickness at which the heat transferred from the heating roller 82 to the fixing belt 80 propagates through the fixing belt 80, can be expressed by the following Eq. (1) when applied to a printer.

$$d_1=\sqrt{\sqrt{a\cdot T_1}} \quad \text{Eq. (1)}$$

Here, when the thermal conductivity is λ [J/s×m×K], the density is ρ [$kg/m^3$], and the specific heat is Cp [J/kg×K], the thermal diffusivity a [$m^2/s$] takes a value determined by the following Eq. (2).

$$a=\lambda/(\rho\cdot Cp) \quad \text{Eq. (2)}$$

When the thickness of the fixing belt 80 is set at D [m] such that the thickness of the fixing belt 80 is thicker than a thickness at which the heat transferred to the fixing belt 80 from the heating roller 82 propagates through the interior of the fixing belt 80, the heating efficiency can be maintained by ensuring that $d_1 \leqq D$ is satisfied, and the thickness of the fixing belt 80 is set such that the following Eq. (3) is established.

$$\sqrt{a\cdot T_1} \leqq D \quad \text{Eq. (3)}$$

Here, when the length of the heating region H is $L_1$ [m] and the linear speed of the fixing belt 80, or in other words the process speed, is V [m/s], $T_1=L_1/V$ [s] is obtained.

The material and thickness of the fixing belt 80 are determined in advance, and when the linear speed of the fixing belt 80 is determined in advance by determining the process speed from the image creation speed of the image creation process, the length of the heating region H is calculated at a maximum value within the range of $L_1$ [m] by determining $T_1$ so as to satisfy Eq. (1). If the heating region H is made longer than the calculated maximum value of $L_1$ [m], heating is performed with poor heating efficiency. By setting $L_1$ [m] within a range for maintaining the heating efficiency, a reduction in the diameter of the heating roller 82 can be achieved. By reducing the size of the heating roller 82, a reduction in the size of the fixing device 8 can be achieved.

Further, by setting the fixing device 8 such that Eq. (3) is satisfied, the heat transferred from the heating roller 82 to the fixing belt 80 does not propagate to the outer peripheral belt surface 80*b* at the heating region outlet 8*a*. Therefore, the surface temperature of the outer peripheral belt surface 80*b* can be made substantially equal at the heating region outlet 8*a* and the heating region inlet 8*e*, and the temperature difference therebetween can be set at no more than 5 [° C.].

At the fixing nip inlet 8*b*, the heat transferred from the heating roller 82 to the fixing belt 80 contributes to heating of the toner, and therefore the heat must propagate to the outer peripheral belt surface 80*b* before the fixing belt 80 reaches the fixing nip inlet 8*b*. This can be realized by setting the temperature penetration thickness, which is a thickness at which the heat transferred from the heating roller 82 to the fixing belt 80 propagates through the fixing belt 80 from the point at which the fixing belt 80 passes the heating region inlet 8*e* to the point at which the fixing belt 80 reaches the fixing nip inlet 8*b*, to be larger than the thickness of the fixing belt 80. Hence, the fixing device 8 is set such that when the time required for the fixing belt 80 to reach the fixing nip inlet 8*b* after passing the heating region inlet 8*e* is $T_2$, the following Eq. (4) is established.

$$D \leqq \sqrt{a \cdot T_2} \quad \text{Eq. (4)}$$

As a result, the heat from the heating roller 82 can be made to propagate to the non-heated surface before the fixing belt 80 reaches the fixing nip N, and the heat transferred from the heating roller 82 to the fixing belt 80 at the upstream end of the pressing portion can be used to heat the toner. Thus, fixing defects can be suppressed.

At this time, the surface temperature of the outer peripheral belt surface 80*b* at the fixing nip inlet 8*b* may be made higher than the surface temperature of the outer peripheral belt surface 80*b* at the heating region inlet 8*e*.

Using Eq. (3) and Eq. (4), the fixing device 8 is set to satisfy the following Eq. (5).

$$\sqrt{a \cdot T_1} \leqq D \leqq \sqrt{a \cdot T_2} \quad \text{Eq. (5)}$$

By setting the fixing device 8 to satisfy Eq. (5), fixing defects can be suppressed, and the space required for the heating region can be reduced, enabling a reduction in the size of the fixing device.

As regards Eq. (1), the temperature penetration thickness d [m] at the elapsed time T [s] is typically expressed by the following Eq. (6) in terms of heat transfer engineering.

$$d = \sqrt{12 a \cdot T} \quad \text{Eq. (6)}$$

However, in the fixing device 8 of this embodiment, Eq. (3) is derived from Eq. (1). This is based on an empirical knowledge according to which it is valid to consider the temperature penetration thickness in terms of Eq. (1) for practical purposes when fixing an electrophotograph, as described in the aforementioned Japanese Patent No. 2,909,499.

Further, in the fixing device 8, the surface temperature of the outer peripheral belt surface 80*b* is set to reach a suitable temperature for fixing at the fixing nip inlet 8*b* on the upstream end of the fixing nip N serving as the pressing portion in the fixing belt endless motion direction. When the fixing belt 80 enters the fixing nip N, heat is transferred from the fixing belt 80 to the transfer sheet P, and therefore the surface temperature of the outer peripheral belt surface 80*b* begins to fall once the fixing belt 80 has passed the fixing nip inlet 8*b*. Hence, to achieve favorable fixing, the surface temperature of the outer peripheral belt surface 80*b* is set to reach a suitable temperature for fixing at the fixing nip inlet 8*b*.

Further, as shown in FIG. 3B, at the fixing nip inlet 8*b*, the surface temperature of the outer peripheral belt surface 80*b* and the surface temperature of the inner peripheral belt surface 80*a* are set to be substantially equal, i.e. such that the surface temperature difference between the outer peripheral belt surface 80*b* and the inner peripheral belt surface 80*a* is no more than 5 [° C.].

By ensuring that there is substantially no temperature gradient in the interior of the fixing belt 80 at the fixing nip inlet 8*b* in this manner, the amount of heat in the interior of the fixing belt 80 relative to the surface temperature of the outer peripheral belt surface 80*b* can be minimized. As a result, the amount of heat that must be transferred from the heating roller 82 to the fixing belt 80 in the heating region H can be reduced, and power can be saved.

Furthermore, in the fixing device 8, setting is performed to satisfy the following Eq. (7) while performing setting to satisfy the range of Eq. (3).

$$\sqrt{a \cdot T_1} = D \quad \text{Eq. (7)}$$

By performing setting to satisfy Eq. (7), the surface temperature of the outer peripheral belt surface 80*b* begins to rise when the fixing belt 80 passes the heating region outlet 8*a*.

As described above, to perform favorable fixing, the fixing belt 80 must be set such that the surface temperature of the outer peripheral belt surface 80*b* reaches a suitable temperature for fixing at the fixing nip inlet 8*b*. By performing setting to satisfy Eq. (7) such that the surface temperature of the outer peripheral belt surface 80*b* begins to rise in the vicinity of the heating region outlet 8*a*, the time required for the fixing belt 80 to reach the fixing nip inlet 8*b* after passing the heating region outlet 8*a* can be shortened. Accordingly, the distance from the heating region outlet 8*a* to the fixing nip inlet 8*b* can be shortened, and the size of the fixing device 8 can be reduced. Furthermore, the heating efficiency can be maintained at a high level without setting the diameter of the heating roller 82 unnecessarily large, and a sufficient amount of heat can be supplied to the fixing belt 80 from the heating roller 82.

Further, by providing the fixing device 8 described above as the fixing means of the printer 100 serving as an image forming apparatus, the disposal space of the fixing device 8 can be reduced, and hence a reduction in the size of the printer 100 can be achieved.

In this embodiment, equations are used to specify the constitution of the fixing device 8, but these equations do not define a range for physically satisfying the equations, and the size of the fixing device 8 can be reduced by performing setting to satisfy these equations industrially[i].

The temperature penetration thickness, which is the thickness at which the heat transferred from the heating roller 82 to the fixing belt 80 propagates through the interior of the fixing belt 80 within a predetermined time period, is determined by the thermal diffusivity a [$m^2$/s] of the fixing belt 80 and the elapsed time T [s] from the start of heating. Here, the thermal diffusivity a [$m^2$/s] is a substance-specific physical property value, but in the fixing device 8 of this embodiment, the fixing belt 80 having a multilayer structure is used.

In this embodiment, a substance taking a plurality of substances forming a multilayer structure as a single substance is referred to as an effective substance, and the temperature penetration thickness is calculated using the thermal diffusivity of the effective substance as the thermal diffusivity a [$m^2$/s] of the fixing belt 80.

A method of calculating a thermal diffusivity $a_E$ of the effective substance will now be described.

In the present invention, a substance taking two substances (substance A, substance B) as a single substance is known as an effective substance.

In the present invention, the following physical property values are indicated by the following symbols.

ρ: density, Cp: specific heat, λ: thermal conductivity, a: thermal diffusivity, l: distance (thickness), T: temperature, ΔT: temperature increase, q: heat flux, Q: amount of heat, and w: depth.

As regards the suffixes attached to each symbol, A indicates a physical property value of the substance A, B indicates a physical property value of the substance B, and E indicates an imaginary physical property value of an effective substance E when a substance having a multilayer structure is considered as the effective substance E.

Figures 4A, 4B:
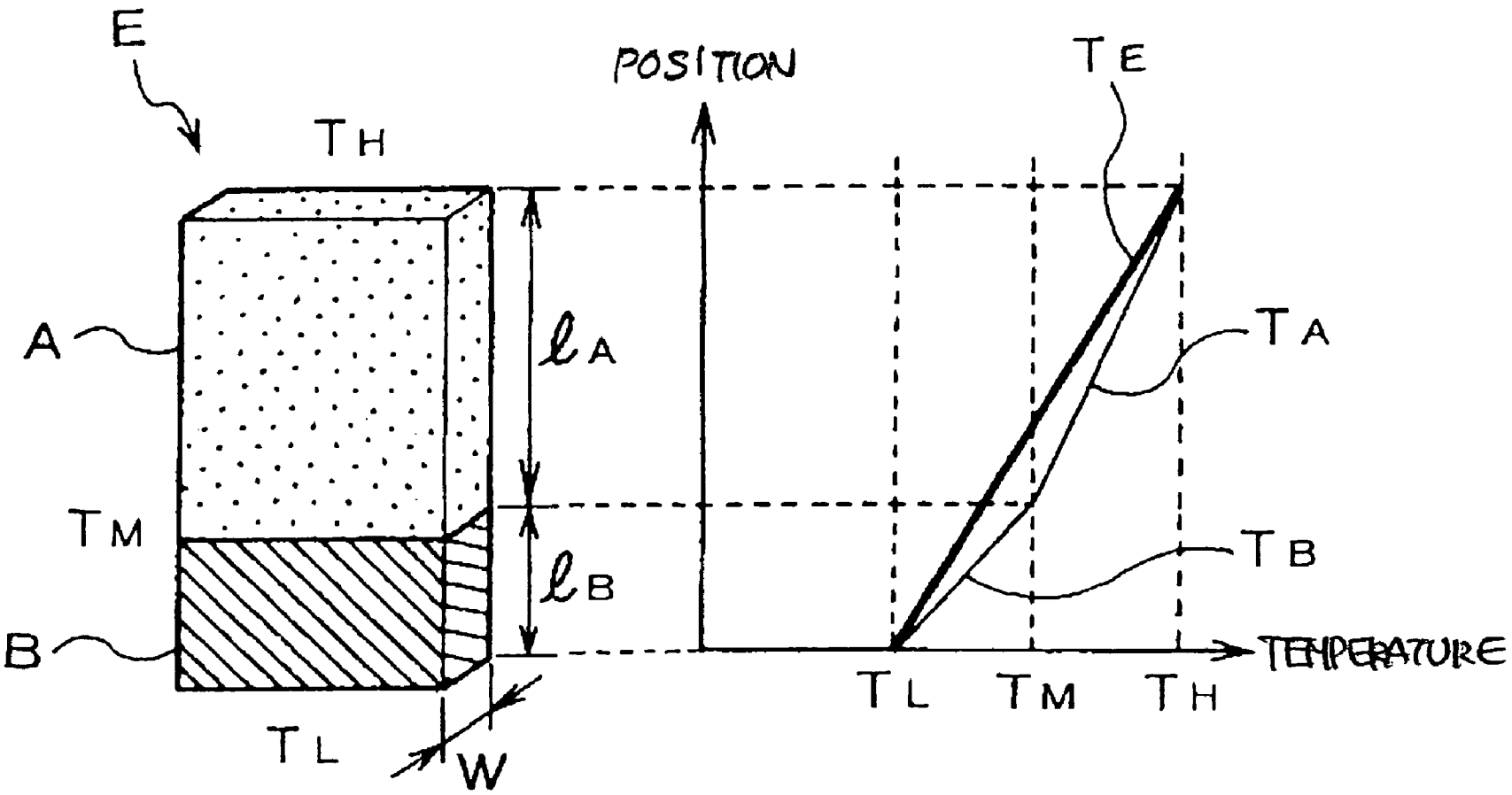
FIG. 4A is a view illustrating an effective substance taking two substances as a single substance.
FIG. 4B is a graph showing the temperature distribution of the effective substance.

FIG. 4A is a schematic diagram illustrating an effective substance, and FIG. 4B is a graph showing the temperature distribution of the effective substance.

As shown in FIG. 4A, the effective substance E has a multilayer structure constituted by a substance A having a thickness $l_A$ and a substance B having a thickness $l_B$. A temperature difference between the two surfaces of the effective substance E is set such that the surface temperature on the substance A side is $T_H$ and the surface temperature on the substance B side is $T_L$. The temperature at the boundary between the substance A and the substance B at this time is set at $T_M$. At this time, $T_L<T_M<T_H$ is established.

Further, when the actual temperature distribution of the substance A is $T_A$ and the actual temperature distribution of the substance B is $T_B$, an imaginary temperature distribution $T_E$ of the effective substance E is as shown in FIG. 4B.

First, derivation of an effective thermal conductivity $\lambda_E$ of the effective substance E will be described.

Here, an equation of heat conduction of the substance A in a steady state is expressed by the following Eq. (8).

$$\dot{q} = \lambda_A \frac{T_H - T_M}{l_A} \quad \text{Eq. (8)}$$

Further, an equation of heat conduction of the substance B in a steady state is expressed by the following Eq. (9).

$$\dot{q} = \lambda_B \frac{T_M - T_L}{l_B} \quad \text{Eq. (9)}$$

Further, an equation of heat conduction of the effective substance E in a steady state is expressed by the following Eq. (10).

$$\dot{q} = \lambda_E \frac{T_H - T_L}{l_A + l_B} \quad \text{Eq. (10)}$$

Using Eqs. (8), (9), and (10), the effective thermal conductivity $\lambda_E$ of the effective substance E is expressed by the following Eq. (11).

$$\lambda_E = \lambda_A \cdot \lambda_B \frac{l_A + l_B}{l_A \cdot \lambda_B + l_B \cdot \lambda_A} \quad \text{Eq. (11)}$$

Next, derivation of the effective heat capacity ($\rho_E \times Cp_E$) of the effective substance E will be described.

When heat amounts $Q_A$, $Q_B$ are applied to the substance A and the substance B, respectively, such that both substances rise in temperature by $\Delta T$, the supply of a heat amount to each substance can be expressed by the following Eqs. (12) and (13).

$$Q_A = \rho_A \cdot Cp_A \cdot (w \cdot I_A) \cdot \Delta T \quad \text{Eq. (12)}$$

$$Q_B = \rho_B \cdot Cp_B \cdot (w \cdot I_B) \cdot \Delta T \quad \text{Eq. (13)}$$

$$Q_E = Q_A + Q_B = \rho_E \cdot Cp_E \cdot (w \cdot I_E) \cdot \Delta T \quad \text{Eq. (14)}$$

According to Eqs. (12), (13), and (14), the effective heat capacity $\rho_E \times Cp_E$ of the effective substance E is expressed by the following Eq. (15).

$$\rho_E \cdot Cp_E = \frac{\rho_A \cdot Cp_A \cdot l_A + \rho_B \cdot Cp_B \cdot l_B}{l_A + l_B} \quad \text{Eq. (15)}$$

Next, derivation of the effective diffusivity $a_E$ of the effective substance E will be described.

Typically, the relationship of the thermal diffusivity with the thermal conductivity and heat capacity is expressed by Eq. (2).

Hence, the effective thermal diffusivity $a_E$ is expressed by the following Eq. (16).

$$a_E = \lambda_E / (\rho_E \cdot Cp_E) \quad \text{Eq. (16)}$$

Further, by inserting Eq. (11) and Eq. (15) into Eq. (16), the effective thermal diffusivity $a_E$ is expressed by the following Eq. (17).

$$a_E = \lambda_A \cdot \lambda_B \frac{(l_A + l_B)^2}{(l_A \cdot \lambda_B + l_B \cdot \lambda_A)(\rho_A \cdot Cp_A \cdot l_A - \rho_B \cdot Cp_B \cdot l_B)} \quad \text{Eq. (17)}$$

In the above description, an effective substance obtained by considering a multilayer structure constituted by two substances to be a single substance was described, but the physical property values of an effective substance having a multilayer structure constituted by three or more substances may be calculated in a similar manner.

Next, a specific example of the fixing device 8 according to this embodiment will be described.

The constitutions of the members of the fixing device 8 according to this example are as follows.

Fixing roller

Core: aluminum, ϕ 60 [mm]; elastic layer: silicone rubber, thickness 80 [mm], surface layer: fluorine resin, thickness 100 [μm]

Pressure roller

Core: aluminum, ϕ 60 [mm]; elastic layer: silicone rubber, thickness 80 [mm], surface layer: fluorine resin, thickness 100 [μm]

Heating roller

Core: aluminum, ϕ 80 [mm]; heater

Fixing belt

Base layer: polyimide resin, layer thickness 100 [μm]; elastic layer: silicone rubber, layer thickness 100 [μm]; surface layer: PFA, layer thickness 20 [μm]

As regards the fixing belt 80, when the thermal diffusivity of the polyimide resin used in this example is 0.13 [$mm^2$/s], the thermal diffusivity of the silicone rubber is 0.14 [$mm^2$/s], the thermal diffusivity of the PFA is 0.12 [$mm^2$/s], and the effective thermal diffusivity of the three-layer fixing belt when considered as an effective substance is 0.13 [$mm^2$/s].

Further, the length of the heating region H in which the fixing belt 80 is wrapped around the heating roller 82 is 125 [mm], and the linear speed of the fixing belt 80 is 0.4 [m/s].

In the fixing device 8 of this example, when a fixing operation was performed with the surface temperature of the heating roller 82 set to 180 [° C.], the surface temperature of the outer peripheral belt surface 80*b* of the fixing belt 80 was 150 [° C.] at the heating region inlet 8*e* and 151 [° C.] at the heating region outlet 8*a*, i.e. substantially equal in these two positions. Further, the temperature of the outer peripheral belt surface 80*b* at the fixing nip inlet 8*b* was 168 [° C.], and therefore favorable fixing was possible.

In accordance with the effective thermal diffusivity of the fixing belt 80, the length of the heating region, and the linear speed of the fixing belt 80, the temperature penetration thickness in the heating region H of this example is 202 [μm], which is smaller than the thickness (100+100+20)=220 [μm] of the fixing belt 80.

In a conventional fixing device using a fixing belt having a similar multilayer structure and an identical linear speed to the fixing belt of this example, in which heating is performed with a heating roller surface temperature of 170 [° C.] such that the temperature of the outer peripheral belt surface reaches 168 [° C.] at the heating region outlet, the length of the heating region must be set at 150 [mm] or more and the diameter of the heating roller must be set at 95 [mm] or more. As a result, the fixing device is larger than the fixing device 8 of this example.

In the embodiment described above, a heating roller is provided as the heating means and the inner peripheral belt surface of the fixing belt is heated. However, the fixing belt surface subjected to heating is not limited to the inner peripheral belt surface, and may be the outer peripheral belt surface. A modification in which the outer peripheral belt surface 80*b* of the fixing belt is heated will now be described.

Figure 5:
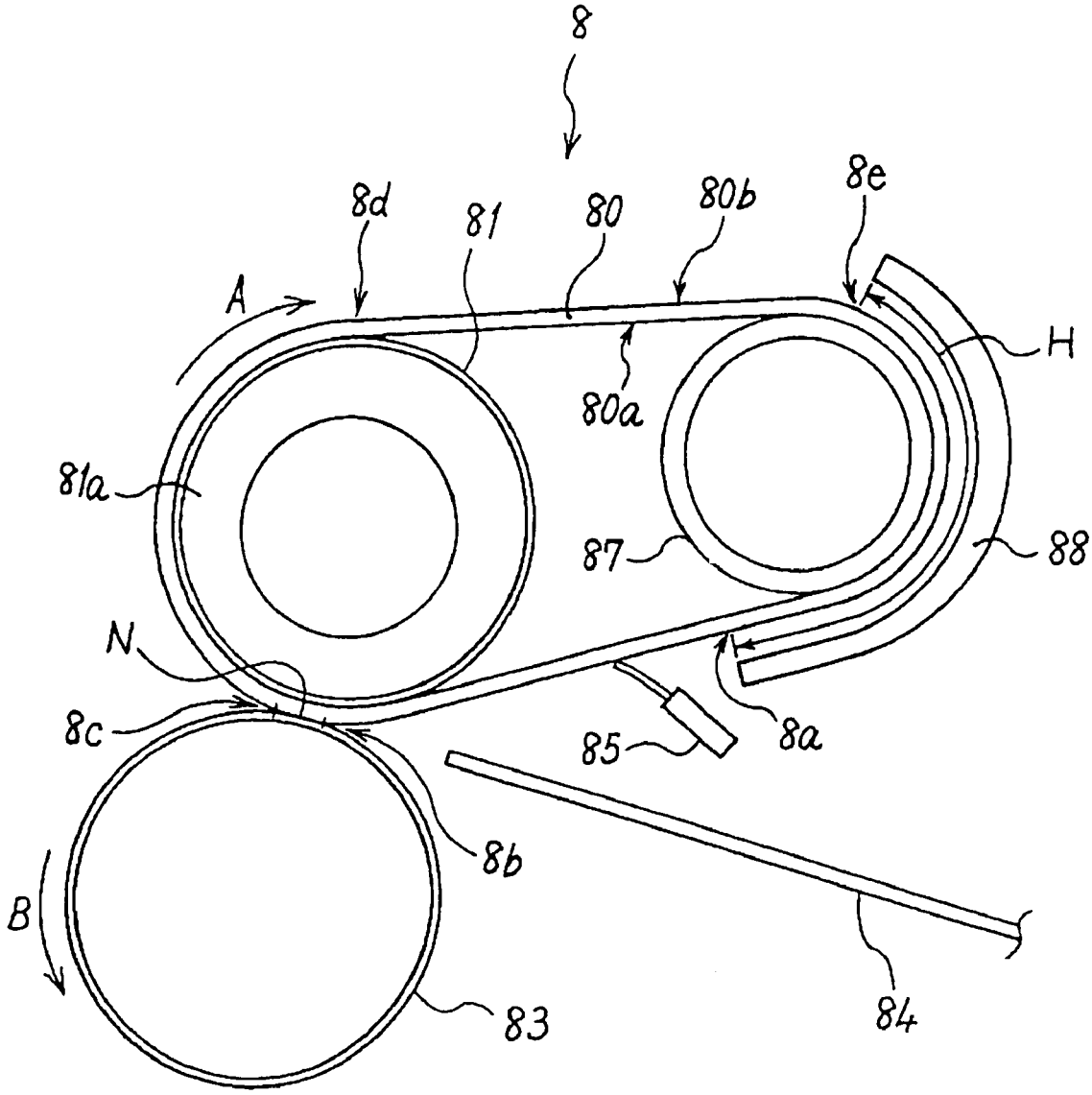
FIG. 5 is a view showing the schematic constitution of a fixing device according to a modification of the embodiment.

FIG. 5 shows the schematic constitution of the fixing device 8 according to this modification.

As shown in FIG. 5, this fixing device 8 comprises the fixing belt 80, fixing roller 81, and pressure roller 83, similarly to the fixing device 8 of the embodiment described above. Instead of the heating roller 82 of the fixing device 8 of the embodiment described above, the fixing device 8 of this modification comprises a stretching roller 87 and a belt heater 88. A halogen heater or the like may be used as the belt heater 88 such that heat is supplied to the fixing belt 80 through radiation heat. Other than being provided with the stretching roller 87 and the belt heater 88, the fixing device 8 of this modification is identical to the fixing device 8 of the above embodiment. Accordingly, description of shared constitutions has been omitted.

In the fixing device 8 of this modification, the outer peripheral belt surface 80*b* serves as the heated belt surface and the inner peripheral belt surface 80*a* serves as the non-heated belt surface. The region in which the belt heater 88 faces the outer peripheral belt surface 80*b* serves as the heating region H.

Likewise in the fixing device 8 of this modification, the surface temperature of the outer peripheral belt surface 80*b* is set to be substantially equal at the heating region outlet 8*a* and the heating region inlet 8*e* such that temperature difference in the surface temperature of the outer peripheral belt surface 80*b* between these two positions is no more than 5 [° C.].

In other words, by setting the thickness of the fixing belt 80 to be thicker than a thickness at which the heat supplied to the fixing belt 80 by the belt heater 88 propagates through the interior of the fixing belt 80 while the fixing belt 80 passes through the heating region H, the efficiency of the heating performed in the heating region H can be maintained at a high level. As a result, the length of the heating region H can be reduced, and the size of the fixing device 8 can be reduced.

In the fixing device 8 of the above embodiment, the heat transferred from the heating roller 82 to the fixing belt 80 must propagate to the outer peripheral belt surface 80*b*, i.e. the non-heated belt surface, before the fixing belt 80 reaches the fixing nip inlet 8*b* in order to perform favorable fixing. In the fixing device 8 of this modification, on the other hand, the outer peripheral belt surface 80*b* that supplies heat to the toner is the heated belt surface, and therefore heat does not have to propagate to the inner peripheral belt surface 80*a*, i.e. the non-heated belt surface, before the fixing belt 80 reaches the fixing nip inlet 8*b*. Moreover, even when heat propagates to the inner peripheral belt surface 80*a*, the surface temperature of the inner peripheral belt surface 80*a* does not have to be raised to a suitable temperature for fixing.

In the fixing device 8 of this modification, the required amount of heat for fixing the toner can be supplied by the fixing nip N regardless of the surface temperature of the inner peripheral belt surface 80*a* serving as the non-heated surface. Therefore, in the fixing device of this modification, the distance between the heating region outlet 8*a* and the fixing nip inlet 8*b* can be made shorter than that of the fixing device 8 according to the above embodiment, and as a result, a further reduction in the size of the fixing device 8 can be achieved.

According to the embodiment described above, the surface temperature of the outer peripheral belt surface 80*b*, i.e. the non-heated belt surface, of the fixing belt 80 is set to be substantially equal at the heating region outlet 8*a* located at the downstream end of the heating region and the heating region inlet 8*e* located at the upstream end of the heating region, whereby the temperature difference between the surface temperature of the outer peripheral belt surface 80*b* at the heating region inlet 8*e* and the surface temperature of the outer peripheral belt surface 80*b* at the heating region outlet 8*a* is no more than 5 [° C.]. Hence, heat transfer from the heating roller 82 serving as heating means to the fixing belt 80 is terminated before heat transferred from the heating roller 82 to the inner peripheral belt surface 80*a*, i.e. the heated belt surface, of the fixing belt 80 propagates to the outer peripheral belt surface 80*b* or soon after the heat propagates to the outer peripheral belt surface 80*b*. As a result, a reduction in the amount of heat transferred from the heating roller 82 to the inner peripheral belt surface 80*a* within the heating region H per unit time caused by a reduction in the temperature difference between the outer peripheral belt surface 80*b* and inner peripheral belt surface 80*a* can be prevented. Accordingly, heating in a state of reduced heating efficiency due to a reduction in the amount of heat transferred to the inner peripheral belt surface 80*a* per unit time can be prevented, and the fixing belt 80 can be heated with favorable heating efficiency. By performing heating efficiently, the heating time can be shortened, and the heating region H can be reduced in length. Further, by setting the surface temperature of the outer peripheral belt surface 80*b* at the fixing nip inlet 8*b*, or in other words at the upstream end of the fixing nip N serving as the pressing portion, to be higher than the surface temperature of the outer peripheral belt surface 80*b* at the heating region inlet 8*e*, the heat from the heating roller 82 can be propagated to the outer peripheral belt surface 80*b* before the fixing belt 80 reaches the fixing nip N, and the heat that is transferred from the heating roller 82 to the fixing belt 80 can be used to heat the toner from the fixing nip inlet 8*b*. When the heat transferred from the heating roller 82 to the fixing belt 80 is used to heat the toner from the fixing nip inlet 8*b* in this manner, fixing defects can be suppressed, and the heating region H can be shortened, enabling a reduction in the space required for the heating region H and a reduction in the size of the fixing device 8.

Further, by setting the fixing belt 80 such that the surface temperature of the outer peripheral belt surface 80*b* begins to rise in the vicinity of the heating region outlet 8*a*, the distance from the heating region outlet 8*a* to the fixing nip inlet 8*b* can be shortened, and the size of the fixing device 8 can be reduced.

Further, by performing setting such that Eq. (5) is satisfied, the time required for the heat transferred from the heating roller 82 to the inner peripheral belt surface 80*a* to propagate to the outer peripheral belt surface 80*b* can be set to be identical to or longer than the time required for the fixing belt 80 to pass through the heating region H. Hence, heat transfer from the heating roller 82 to the fixing belt 80 is terminated before the heat that is transferred from the heating roller 82 to the fixing belt 80 propagates to the outer peripheral belt surface 80*b* or soon after the heat propagates to the outer peripheral belt surface 80*b*. As a result, a reduction in the amount of heat transferred from the heating roller 82 to the inner peripheral belt surface 80*a* within the heating region H per unit time caused by a reduction in the temperature difference between the outer peripheral belt surface 80*b* and inner peripheral belt surface 80*a* can be prevented. Accordingly, heating in a state of reduced heating efficiency due to a reduction in the amount of heat transferred to the inner peripheral belt surface 80*a* per unit time can be prevented, and the fixing belt 80 can be heated with favorable heating efficiency. By performing heating efficiently, the heating time can be shortened, and the heating region H can be reduced in length.

Further, by setting the surface temperature of the outer peripheral belt surface 80*b* at the fixing nip inlet 8*b*, or in other words at the upstream end of the fixing nip N, to be higher than the surface temperature of the outer peripheral belt surface 80*b* at the heating region inlet 8*e*, the heat from the heating roller 82 can be propagated to the outer peripheral belt surface 80*b* before the fixing belt 80 reaches the fixing nip N, and the heat that is transferred from the heating roller 82 to the fixing belt 80 can be used to heat the toner from the fixing nip inlet 8*b*. When the heat transferred from the heating roller 82 to the fixing belt 80 is used to heat the toner from the fixing nip inlet 8*b* in this manner, fixing defects can be suppressed, and the heating region H can be shortened, enabling a reduction in the space required for the heating region H and a reduction in the size of the fixing device 8.

Furthermore, by performing setting such that Eq. (5) is satisfied, the time required for the heat of the heating roller 82 to propagate to the non-heated belt surface can be set to be identical to or shorter than the time required for the fixing belt to perform an endless motion from the upstream end of the heating region to the upstream end of the pressing portion. In so doing, the heat from the heating roller 82 can be propagated to the outer peripheral belt surface 80*b* before the fixing belt 80 reaches the fixing nip inlet 8*b*, and the heat that is transferred from the heating roller 82 to the fixing belt 80 can be used to heat the toner from the fixing nip inlet 8*b*.

Furthermore, by performing setting such that the surface temperature of the outer peripheral belt surface 80*b* of the fixing belt 80 reaches a suitable temperature for fixing at the fixing nip inlet 8*b*, favorable fixing can be realized. Moreover, by making the surface temperature of the inner peripheral belt surface 80*a* of the fixing belt 80 and the surface temperature of the outer peripheral belt surface 80*b* of the fixing belt 80 substantially equal at the fixing nip inlet 8*b* such that the temperature difference therebetween is no more than 5 [° C.], the amount of heat that must be transferred from the heating roller 82 to the fixing belt 80 in the heating region H can be reduced, and power can be saved.

The featured constitution of this embodiment may be applied to a fixing device 8 in which the inner peripheral belt surface 80*a* of the fixing belt 80 is heated by the heating roller 82 and the fixing nip N is formed between the fixing roller 81 and the pressure roller 83 serving as pressing means.

Further, when the belt heater 88 is provided and the outer peripheral belt surface 80*b* of the fixing belt 80 is heated, as in the modification, the heating region H can be reduced in length and no time is required for heat to propagate to the inner peripheral belt surface 80*a* serving as the non-heated belt surface. Therefore, the distance between the heating region outlet 8*a* and the fixing nip inlet 8*b* can be reduced.

Further, by employing the fixing device 8 of this embodiment as the fixing means of the printer 100 serving as an image forming apparatus, the size of the printer 100 can be reduced.

According to the present invention described above, heat transferred from the heating means to the fixing belt is used to heat the toner from the upstream end of the pressing portion. Hence, fixing defects can be suppressed and the heating region can be reduced in length, enabling a reduction in the amount of space required for the heating region and a reduction in the size of the fixing device.

Various modifications will become possible for those skilled in the art after receiving the teachings of the present disclosure without departing from the scope thereof.

What is claimed is:

1. A fixing device comprising:

a fixing belt that performs an endless motion while stretched by a plurality of stretching members and is heated by a heating arrangement, said fixing belt having a multilayer structure including a base layer, an elastic layer on the base layer, and a surface layer on the elastic layer, wherein the base layer, elastic layer, and surface layer are formed of different materials, the surface layer being a fluorine resin layer; and a pressing instrument for pressing said fixing belt, wherein said fixing belt heated in a heating region in which said heating arrangement heats said fixing belt performs an endless motion to a pressing portion in which said pressing instrument presses said fixing belt, and a recording body carrying an unfixed toner image passes through said pressing portion such that said unfixed toner image is fixed onto said recording body by heat from said fixing belt and pressure from said pressing instrument, on a non-heated belt surface, which is a surface of said fixing belt on a rear side of a heated belt surface facing said heating arrangement, a temperature difference between a surface temperature of said non-heated belt surface at an upstream end of said heating region in a fixing belt endless motion direction and said surface temperature of said non-heated belt surface at a downstream end of said heating region in said fixing belt endless motion direction is no more than 5 (° C.), and said surface temperature of said non-heated belt surface at an upstream end of said pressing portion in said fixing belt endless motion direction is higher than said surface temperature of said non-heated belt surface at said upstream end of said heating region in said fixing belt endless motion direction.

2. The fixing device as claimed in claim 1, wherein said surface temperature of said non-heated belt surface begins to rise in the vicinity of said downstream end of said heating region in said fixing belt endless motion direction.

3. The fixing device as claimed in claim 1, wherein a temperature of an outer peripheral surface of said fixing belt reaches a suitable temperature for fixing at said upstream end of said pressing portion in said fixing belt endless motion direction.

4. The fixing device as claimed in claim 1, wherein a temperature difference between a surface temperature of an inner peripheral surface of said fixing belt and a surface temperature of an outer peripheral surface of said fixing belt is no more than 5 (° C.) at said upstream end of said pressing portion in said fixing belt endless motion direction.

5. The fixing device as claimed in claim 1, wherein said heating arrangement heats an inner peripheral surface of said fixing belt.

6. The fixing device as claimed in claim 5, wherein said heating arrangement comprises a heating roller for stretching said fixing belt in said heating region.

7. The fixing device as claimed in claim 1, wherein said heating arrangement heats an outer peripheral surface of said fixing belt.

8. The fixing device as claimed in claim 1, wherein a fixing roller facing said pressing instrument via said fixing belt is provided as one of said plurality of stretching members, and a pressing roller is provided as said pressing instrument.

9. A fixing device comprising:

a fixing belt that performs an endless motion while stretched by a plurality of stretching members and is heated by a heating arrangement, said fixing belt having a multilayer structure including a base layer, an elastic layer on the base layer, and a surface layer on the elastic layer, wherein the base layer, elastic layer, and surface layer are formed of different materials, the surface layer being a fluorine resin layer; and a pressing instrument for pressing said fixing belt, wherein said fixing belt heated in a heating region in which said heating arrangement heats said fixing belt performs an endless motion to a pressing portion in which said pressing instrument presses said fixing belt, and a recording body carrying an unfixed toner image passes through said pressing portion such that said unfixed toner image is fixed onto said recording body by heat from said fixing belt and pressure from said pressing instrument, and when a time required for said fixing belt to pass a downstream end of said heating region in a fixing belt endless motion direction after passing an upstream end of said heating region in said fixing belt endless motion direction is $T_1$ (s), a time required for said fixing belt to pass an upstream end of said pressing portion in said fixing belt endless motion direction after passing said upstream end of said heating region in said fixing belt endless motion direction is $T_2$ (s), a thickness of said fixing belt is D (m), and a thermal diffusivity of said fixing belt is "a" ($m^2/s$), then $$\sqrt{a \cdot TT_1} \leq \sqrt{a \cdot T_2}$$

where, when a thermal conductivity is λ (J/s×m×K), a density is ρ ($kg/m^3$), and a specific heat is Cp (J/kg×K), said thermal diffusivity "a" ($m^2/s$) takes a value determined by $$a = \lambda/(\rho \cdot Cp) \quad \text{Eq. (2).}$$

10. The fixing device as claimed in claim 9, wherein a temperature of an outer peripheral surface of said fixing belt reaches a suitable temperature for fixing at said upstream end of said pressing portion in said fixing belt endless motion direction.

11. The fixing device as claimed in claim 9, wherein a temperature difference between a surface temperature of an inner peripheral surface of said fixing belt and a surface temperature of an outer peripheral surface of said fixing belt is no more than 5 (° C.) at said upstream end of said pressing portion in said fixing belt endless motion direction.

12. The fixing device as claimed in claim 9, wherein said heating arrangement heats an inner peripheral surface of said fixing belt.

13. The fixing device as claimed in claim 11, wherein said heating arrangement comprises a heating roller for stretching said fixing belt in said heating region.

14. The fixing device as claimed in claim 9, wherein said heating arrangement heats an outer peripheral surface of said fixing belt.

15. The fixing device as claimed in claim 9, wherein a fixing roller facing said pressing instrument via said fixing belt is provided as one of said plurality of stretching members, and a pressing roller is provided as said pressing instrument.

16. An image forming apparatus comprising:

an image carrier;

an image forming unit for forming a latent image on the image carrier;

a development device for developing the latent image on the image carrier to form a toner image;

a transfer device for transferring the toner image to a recording body; and a fixing device for fixing the toner image onto the recording body, said fixing device comprising:

a fixing belt that performs an endless motion while stretched by a plurality of stretching members and is heated by a heating arrangement, said fixing belt having a multilayer structure including a base layer, an elastic layer on the base layer, and a surface layer on the elastic layer, wherein the base layer, elastic layer, and surface layer are formed of different materials, the surface layer being a fluorine resin layer; and a pressing instrument for pressing said fixing belt, wherein said fixing belt heated in a heating region in which said heating arrangement heats said fixing belt performs an endless motion to a pressing portion in which said pressing instrument presses said fixing belt, and said recording body carrying an unfixed toner image passes through said pressing portion such that said unfixed toner image is fixed onto said recording body by heat from said fixing belt and pressure from said pressing instrument, on a non-heated belt surface, which is a surface of said fixing belt on a rear side of a heated belt surface facing said heating arrangement, a temperature difference between a surface temperature of said non-heated belt surface at an upstream end of said heating region in a fixing belt endless motion direction and said surface temperature of said non-heated belt surface at a downstream end of said heating region in said fixing belt endless motion direction is no more than 5 (° C.), and said surface temperature of said non-heated belt surface at an upstream end of said pressing portion in said fixing belt endless motion direction is higher than said surface temperature of said non-heated belt surface at said upstream end of said heating region in said fixing belt endless motion direction.

17. An image forming apparatus comprising:

an image carrier;

an image forming unit for forming a latent image on the image carrier;

a development device for developing the latent image on the image carrier;

a transfer device for transferring the toner image to a recording body; and a fixing device for fixing the toner image on the recording body, said fixing device comprising:

a fixing belt that performs an endless motion while stretched by a plurality of stretching members and is heated by a heating arrangement, said fixing belt having a multilayer structure including a base layer, an elastic layer on the base layer, and a surface layer on the elastic layer, wherein the base layer, elastic layer, and surface layer are formed of different materials, the surface layer being a fluorine resin layer; and a pressing instrument for pressing said fixing belt, wherein said fixing belt heated in a heating region in which said heating arrangement heats said fixing belt performs an endless motion to a pressing portion in which said pressing instrument presses said fixing belt, and said recording body carrying an unfixed toner image passes through said pressing portion such that said unfixed toner image is fixed onto said recording body by heat from said fixing belt and pressure from said pressing instrument, and when a time required for said fixing belt to pass a downstream end of said heating region in a fixing belt endless motion direction after passing an upstream end of said heating region in said fixing belt endless motion direction is $T_1$ (s), a time required for said fixing belt to pass an upstream end of said pressing portion in said fixing belt endless motion direction after passing said upstream end of said heating region in said fixing belt endless motion direction is $T_2$ (s), a thickness of said fixing belt is D (m), and a thermal diffusivity of said fixing belt is "a" ($m^2/s$), then $$\sqrt{a \cdot T_1} \leqq D \leqq \sqrt{a \cdot T_2}$$

where, when a thermal conductivity is λ (J/s×m×K), a density is ρ ($kg/m^3$), and a specific heat is Cp (J/kg×K), said thermal diffusivity "a" ($m^2/s$) takes a value determined by $$a = \lambda / \rho \cdot Cp) \qquad \text{Eq. (2).}$$

18. A fixing device comprising:

a fixing belt stretched by a plurality of stretching members and configured to perform an endless motion around said plurality of stretching members, said fixing belt having a heated belt surface heated by a heating arrangement in a heating region and a non-heated belt surface on an opposite side of said heated belt surface, said fixing belt having a multilayer structure including a base layer, an elastic layer on the base layer, and a surface layer on the elastic layer, wherein the base layer, elastic layer, and surface layer are formed of different materials, the surface layer being a fluorine resin layer; and a pressing instrument for pressing said fixing belt, said fixing belt being pressed by said pressing instrument at a pressing portion, wherein said fixing belt and said pressing instrument are configured to allow a recording body carrying an unfixed toner image to pass through said pressing portion such that said unfixed toner image is fixed onto said recording body by heat from said fixing belt and pressure from said pressing instrument, and a difference between a surface temperature of said non-heated belt surface at an upstream end and a downstream end of said heating region is no more than 5° C.

19. The fixing device of claim 18, wherein said healing arrangement includes a heating roller.

20. The fixing device of claim 18, wherein said plurality of stretching members includes a fixing roller, and said pressing instrument is a pressing roller.

* * * * *